United States Patent [19]

Belardi et al.

[11] 4,084,401

[45] Apr. 18, 1978

[54] DIGITAL WATCH WITH TWO BUTTONS AND IMPROVED SETTING AND DISPLAY CONTROL

[75] Inventors: Richard J. Belardi, Anaheim; Norman E. Moyer; Ernest C. Ho, both of Newport Beach, all of Calif.

[73] Assignee: Hughes Aircraft Company, Culver City, Calif.

[21] Appl. No.: 594,384

[22] Filed: Jul. 9, 1975 (Under 37 CFR 1.47)

[51] Int. Cl.[2] ..... G04B 19/24

[52] U.S. Cl. ..... 58/4 A; 58/50 R

[58] Field of Search ..... 58/23 R, 23 BA, 50 R, 58/127 R, 4 A

[56] References Cited

U.S. PATENT DOCUMENTS

| | | | |
|---|---|---|---|
| 3,747,323 | 7/1973 | Eckenrode | 58/50 R |
| 3,757,511 | 9/1973 | Burgess et al. | 58/127 R X |
| 3,760,584 | 9/1973 | Dargent | 58/50 R |
| 3,802,182 | 4/1974 | Fujita | 58/50 R |
| 3,810,356 | 5/1974 | Fujita | 58/23 R |
| 3,823,551 | 7/1974 | Riehl | 58/50 R X |
| 3,939,640 | 2/1976 | Kahn | 58/50 R X |

*Primary Examiner*—Ulysses Weldon
*Attorney, Agent, or Firm*—Fay I. Konzem; W. H. MacAllister

[57] ABSTRACT

A digital LED display watch is provided with 1) an operating button to select and control display of data in the normal operating mode, and 2) a recessed button to select separately for possible setting each unit of horological data except seconds. The display of the data selected for possible setting is flashed, and the actual advancing is controlled by the operating button. The data displayed in the normal mode is timed hours-minutes, separated by a colon, with seconds after hours-minutes if the operating button is held down, and month-date separated by a dash if the operating button is pushed twice. In the setting mode, data not being set (but otherwise associated in the display with data that is) is blanked, but the colon or dash is retained. During setting of hours the dash is added to the colon during the first 12 hours of each day to indicate AM. An optional recessed button is provided to manually select the duty cycle of the LED display and thus alter apparent brightness and power consumed.

6 Claims, 4 Drawing Figures

DIGITAL WATCH WITH TWO BUTTONS AND IMPROVED SETTING AND DISPLAY CONTROL

BACKGROUND OF THE INVENTION

1. Field of the Invention

This invention relates to digital electronic watches, and more particularly to a digital watch having a light emitting diode (LED) display, capable of displaying horological data.

2. Description of the Prior Art

In the art, the practice has been to provide for the display of four digits, and to utilize the four digits to display either hours-minutes, seconds, or month-date. To avoid confusion of data, it is necessary to provide some way of indicating the nature of the data displayed. For example, if the time is 3:15, and the actual date is March 14, display of the month-date might be 3:14, but then there is a possibility of inadvertently calling for the time and thus obtaining the wrong date information. And even when the time is intended and displayed, it is sometimes desirable to indicate whether it is in the first or second twelve hours of a day. A 24-hour watch avoids that problem, but the greater market demand is for a 12-hour watch. In the past, a colon has been used to separate the hours and minutes in the display. When month-day is called up for display, only a half colon is displayed, thus indicating the time as 3:15 and the date as 3.15.

Electronic digital watches are quite accurate so that, once set, it is rarely necessary to again set the watch. However, on the few occasions that a watch is to be set, it is necessary to call up for display that part of the horological data that is in error. For example, when traveling across time zones or when a change is made to or from daylight savings time, it will be necessary to advance the hours counter to the proper hour. To accomplish that, the output of the hours counter must be displayed. In setting the hours there is an added problem of also indicating AM or PM. Otherwise the horological data can be a half day off.

The practice has been to provide one recessed button to control watch setting modes and one large button to control normal display of the horological data. In a watch having month, date hours, and minutes information, and separately controlled setting of month, date, hours and minutes, it is necessary to provide control of five operating modes with the recessed button, as follows: normal, month set, date set, hours set, and minutes set, each with corresponding display. It is mandatory to provide some indication to the user of the mode selected by the recessed button.

SUMMARY OF THE INVENTION

The improved digital electronic watch of the present invention is provided with a four-digit LED display capable of displaying combined horological data with hours and minutes separated by a colon in one normal display mode, and month and date separated by a dash in another normal display mode. Seconds are displayed alone in the two digit positions normally used to display minutes. A large button (LB) is pushed once to initiate a timed hour-minute display as a normal display mode. If the button is released before the display timer runs out, the LED display is turned off automatically, but if the large button is held in, the end of the display timing period initiates a flashing seconds display until the large button is released. The hours and minutes are separated by a colon formed by two LED dots turned on with the hour-minute display. For a timed month-date display, the large button is quickly pushed twice. If held in after the second push, the display timer is overridden and the month-date display continues until the button is released. A dash formed by one LED segment is displayed between the month and date.

For setting the watch, a recessed button (RB) is pushed a number of times to cause the month, date, hours, or minutes to be separately displayed in that order. A 1Hz pulse from the divider chain periodically blanks the display to cause the horological data selected for display to flash on and off. The month data, selected for display with one push, is displayed in the two left hand digit positions normally used for month display with the dash following to indicate that the data displayed is the month. The date data selected for display with two pushes after normal, or one push after month select, is displayed in its usual position (two right hand digits of the four digit display), with the dash in front of it. The hours selected for display with three pushes after normal, or one push after date select, is displayed in its usual position on the left with the colon following. If the hours are advanced, the dash is on for the first twelve hours of the day to indicate AM. One more button push selects minutes which are displayed in their usual position with the colon in front. Five pushes of the recessed button restores the watch to the normal mode of operation during which no horological data is displayed except by pushing the large button as described above.

A four-bit shift register controls the setting mode selected by the presence of a logic "1" in one of its four bits. If in the normal state, one push shifts a single logic "1" into the first bit to take the watch out of the normal mode, and four more pushes shift the logic "1" until all bits contain a logic 0, returning to the normal state. At each bit, the stored logic "1" causes a flashing display of the horological data selected, enables the selected data to be slewed upon pushing of the large button and blanks display of the other horological data usually present. All faster counters operate normally while the selected one is being slewed. No slewed counter will increment slower time units except that upon setting the date counter, an overflow is allowed to increment the month counter.

The features of the present invention which are believed to be novel are set forth with particularity in the appended claims. The present invention, both as to its organization and manner of operation, together with further objects and advantages thereof, may be understood best by reference to the following description, taken in connection with the accompanying drawings.

DETAILED DESCRIPTION

Figure 1:
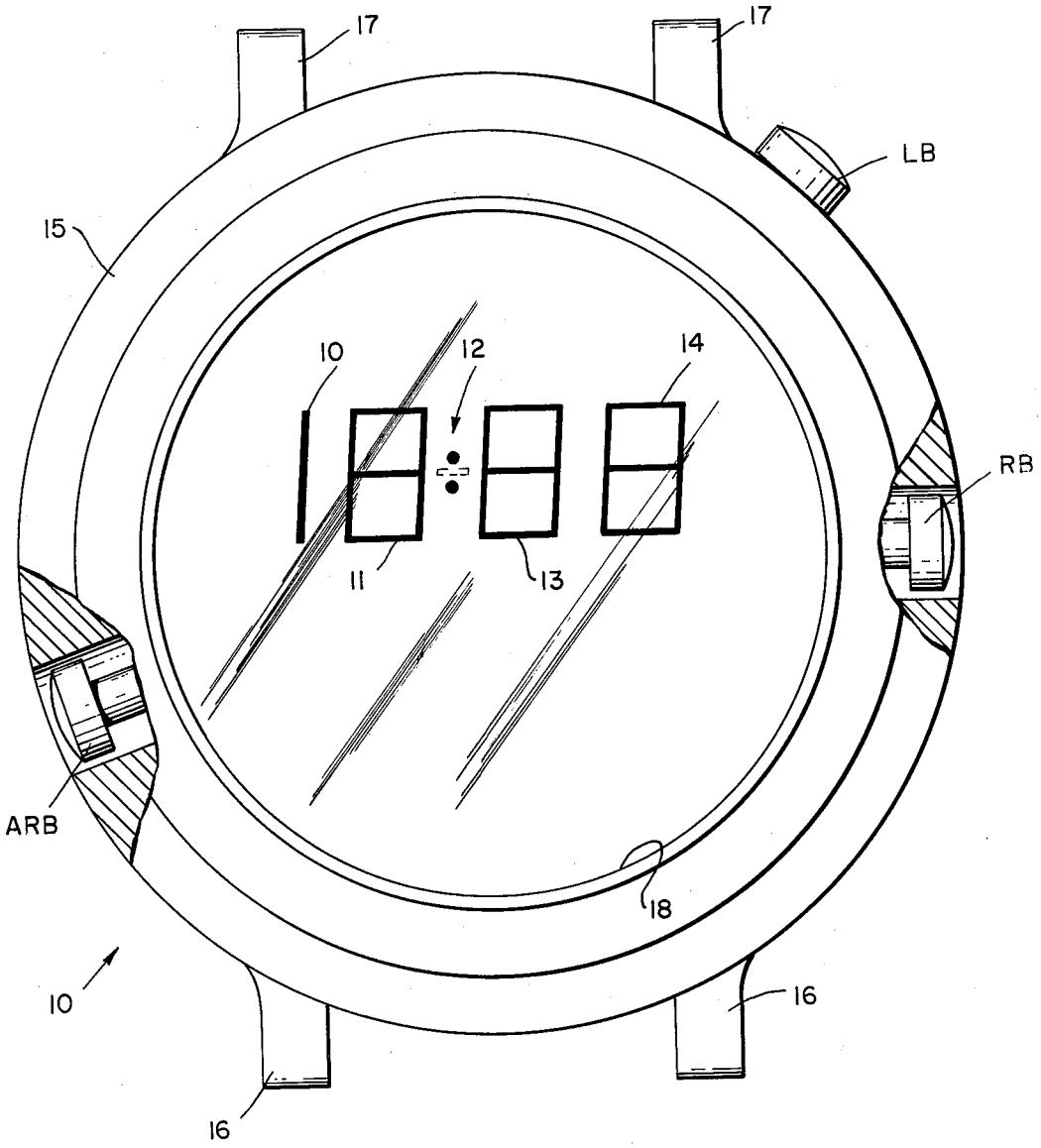
FIG. 1 is a top view of a digital watch with a 3½ digit LED display.

Referring now to FIG. 1, a digital wristwatch is shown having LED display elements in five groups 10 through 14 for display of horological data. The watch is enclosed in a case which is provided with strap-securing ears 16 and 17. Compact batteries (not shown) are included in the case to supply power for the electronic circuitry to be described with reference to FIGS. 2, 3 and 4. A face crystal 18 is mounted on the front of the watch case. The face crystal can be a color selected to enhance the LED display.

In the preferred embodiment, the watch is a wristwatch. However, it should be clearly understood that the same construction, circuitry and display can be employed in a pocket watch.

The LED display includes four digit positions. The leftmost position consists of two segments for display of the number "1" in display of hours 10, 11 and 12 and display of months 10, 11 and 12. The remaining digit positions, groups 11, 13 and 14, each consist of seven segments. As will be noted more fully hereinafter, the horological data from the logic circuitry is converted from binary-coded decimal (BCD) data to a 7-segment data to energize selected segments to form decimal digits on the displays. The LED display remains off during the normal mode of operation, except when the large button LB is depressed. When it is desired to display either the month-date or the hours-minutes, the colon/dash 12 is also selectively energized. This is most easily done during the time that the leftmost digit is on because unused segments are available for the dash and colon. For the month-date display, the horizontal bar segment is energized to display a dash, and for the hour-minutes display, the two dot segments are energized to display a colon. Both the dash and the colon are displayed when the time is during AM hours and the hours are actually being advanced.

One push of the button LB will produce a timed ($\frac{3}{4}$ second) display of the hours-minutes data, separated by a colon. If the button is released before the $\frac{3}{4}$ second timer times out, the display is turned off at the end of the $\frac{3}{4}$ second time. Otherwise the timed hour-minute display is followed by a flashing seconds display in the LED digit positions 13 and 14 until the button is released. Two quick pushes on LB produce a timed month-date display, with the dash in position 12 appearing between the month and date, until the button is released or until the $\frac{3}{4}$ second timer times out, whichever is longer. Thus a typical time display would be 10:32 and a typical date display would be 3–10. The dash will be displayed with the colon, to indicate AM, the first 12 hours of a day, but only during actual slew setting of the hours as controlled by buttons RB and LB.

The basic setting procedure is to push the button RB until the horological data (month, date, hour or minute) to be changed is flashing. Then the button LB is pushed until the counter for the horological data selected is advanced to the correct value. Separate setting of the seconds counter is not provided for. Instead, the seconds counter is set to zero when the minutes counter slew is first initiated. Consequently, to set the minutes counter, it is important to start advancing the minutes exactly when a new minute begins. Otherwise the seconds will be in error. If the watch is less than a minute fast, it can be corrected by pushing the button LB when seconds should be zero, but holding it less than 1 second. A built in time delay prevents a minutes slew from occurring until 1 to 2 seconds after LB is pushed. This gives plenty of time to release LB before minutes slewing starts, but after the seconds were zeroed.

The minute setting mode is reached after four pushes on RB. A fifth push on the button RB will step the setting mode control unit back into the normal mode. The horological data selected for setting is displayed in flashing digits at a rate of 1Hz with a 50% duty cycle. In practice, the on time is selected to be the first half second after the counter has been incremented so as to flash the new value as soon as possible to provide maximum time for the push button to be released. The counter selected for setting is incremented by an edge of the 1Hz pulse train which controls the flashing.

Figure 2:
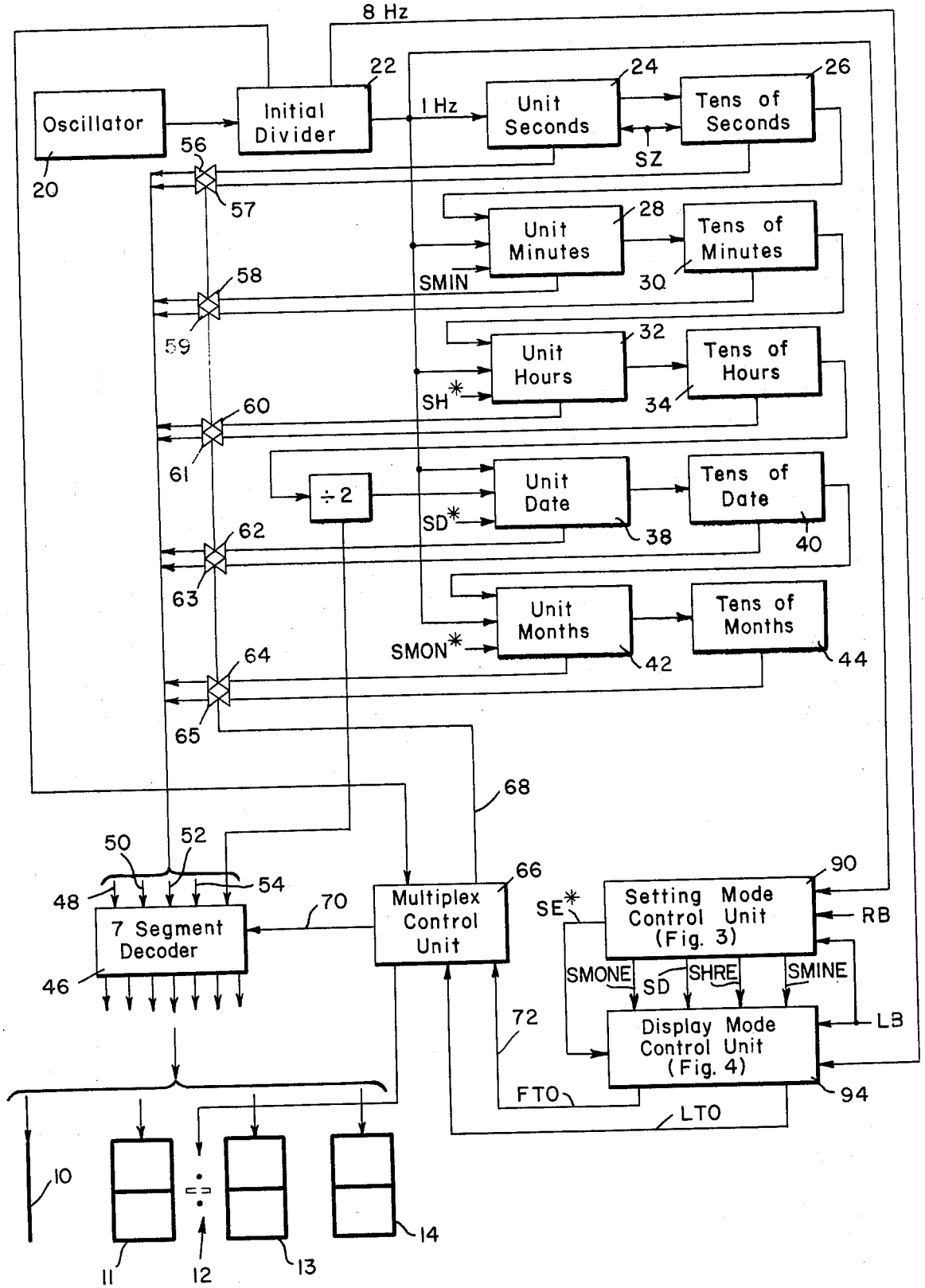
FIG. 2 is a block diagram of the logic circuitry of the digital watch of FIG. 1.

Referring now to FIG. 2, the digital watch circuit consists of an electronic oscillator 20 which is crystal-controlled to oscillate at a predetermined and substantially constant frequency. It, as well as the other circuits, are powered by two compact batteries (not shown) mounted in the watch case. Several or all of the circuits can be and preferably are contained on the same integrated circuit chip to minimize assembly cost and size, and provide a watch of maximum reliability.

The output from the crystal controlled oscillator is driven into a standard CMOS divider 22 which produces output pulses of 1Hz, and 8Hz, and a frequency high enough for multiplexing. The pulses at 1Hz drive a unit seconds counter 24 (a standard CMOS decade counter) which counts up to ten (0–9). The unit seconds counter in turn drives a CMOS tens-of-seconds counter 26 which counts from 0 to 5 to satisfy the requirement of 60 seconds per minute. All successive counters are designed so that at the end of each counter's normal count sequence, a pulse is sent to the next counter in cascade. All outputs taken from the counters are standard 4-bit binary coded decimal (BCD).

The tens-of-seconds counter drives a decade counter for unit minutes 28. The unit minutes counter then drives a tens-of-minutes counter 30, which counts from 0 to 5. The tens-of-minutes counter then drives a unit hours counter 32. Continuing the chain of time keeping counters, the unit hours counter drives a tens-of-hours counter 34. All of these counters are BCD counters, although some don't need four full bits because they count to numbers under 8.

A "12 O'clock" signal from tens-of-hours counter 34 occurs twice a day. This output is connected through divider 36 to the input of unit-date counter 38. Therefore, the unit-date counter 38 advances only once per day. Unit-date counter 38 thus receives a signal once per day and emits a signal every ten days to a tens-of-date counter 40 which need only reach 3. Tens-of-date counter 40 is linked (by logic not shown) to unit-date counter 38 so that, when the total attempts to pass the number of days in the particular month in the month counter, counter 40 resets to zero and counter 38 resets to one. Each time the tens-of-date counter 40 is reset, a pulse is emitted to the unit-months counter 42 which is cascaded with a tens-of-month counter 44 to count the months.

A 7-segment decoder with colon/dash logic 46 receives BCD signals from the time-keeping counters, and control signals from the multiplex control 66 and outputs 7-segment coded signals which correspond to the seven segments of the LED display groups to be energized for display of any decimal digit. For efficiency a single code converter is employed. The BCD inputs and 7-segment code outputs are multiplexed to display the decimal digits of the time-keeping counters.

There are four input lines 48, 50, 52 and 54 to the decoder 46 which carry the BCD information from the counters. Transmission gate sets 56 through 65 are paired as shown to connect each counter's BCD outputs to the input buss of the decoder. The transmission gate sets are all connected to a multiplex control unit 66. The multiplex control unit has three groups of outputs represented by lines 68, 70 and 72. Line 68 is actually a plurality of lines which separately control the transmission gates on the decoder input buss. Lines 70 enable segment outputs and control colon/dash display. Under normal operating conditions, the multiplex control unit 66 operates in such a manner that its output lines 68 deliver pulses to the transmission gate sets so that BCD signals are multiplexed to the decoder 46. Signals over lines 72 control which digits are illuminated so that data appears in the proper position; for example, the 7-segment data for the unit hours digit is distributed to the LED digit 11 while 7-segment data for the unit minutes digit is distributed to the LED digit 14. The multiplex control unit also selects the colon and/or the dash of position 12 for display of a colon when hours-minutes is selected for display and when hours or minutes are selected for setting; and for display of a dash when month-date is selected for display and when month or date are selected for setting; and for display of both a bar and a colon when the hours counter is selected for setting, and is being advanced, and the divide-by-two counter 36 indicates the time is during A.M.

A setting mode control unit 90 is employed to select the time keeping counters to be set in response to pushing the recessed button RB. Each time the button is pushed, a signal RB (which is "debounced" to prevent bouncing contacts from producing multiple signals) is generated. Each signal triggers the unit 90 to sequentially advance one step through five states: normal, set month enable (SMONE), set date enable (SDE), set hours enable (SHRE) and set minutes enable (SMINE). The watch will usually be in the normal state, in which case display is controlled by display mode control unit 94 and LB.

The display mode control unit 94 responds to pushing the large button LB and inputs from 90. Its outputs control the multiplex control 66. One push commands timed display of the hours and minutes, with the colon between the hours and minutes. When a timer runs out, display is terminated unless LB is still pushed in, in which case the seconds will then be flashed until the button is released. If the button is quickly pushed twice, the timed display selected is the month and date, with the dash between the month and date, until the timer times out. If the button is held pushed in, the month and date will continue to be displayed until the button is released.

Figure 3:
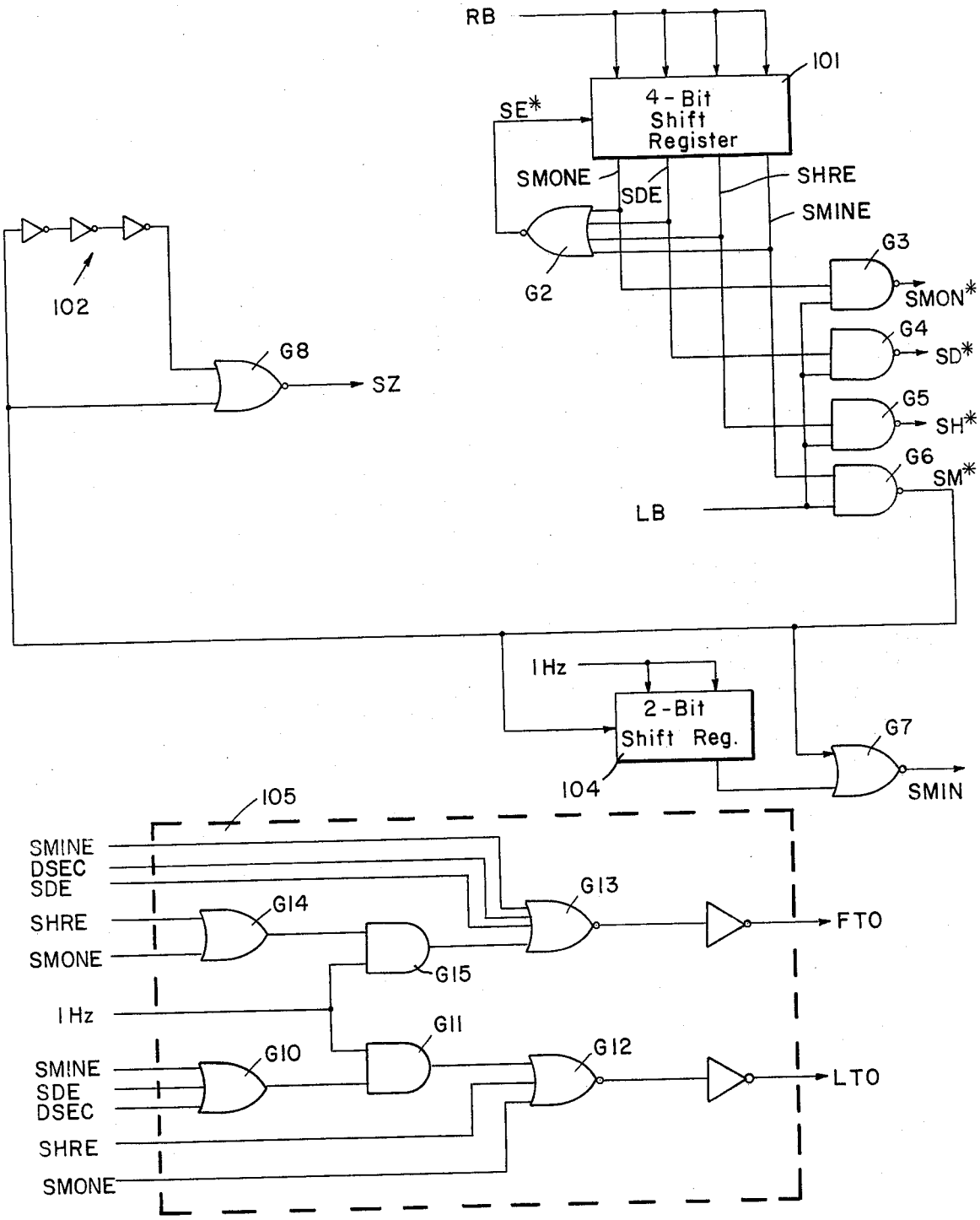
FIG. 3 is a logic diagram of the setting mode control unit in the block diagram of FIG. 2.

As noted hereinbefore, the usual state of the setting control unit 90 is "normal", at which time all four outputs SMONE, SDE, SHRE, and SMINE are zero. In that state, a signal slew enabled inverse, SE*, is transmitted to the display control unit 94 to enable normal display. Referring now to FIG. 3, a push of the recessed button produces a signal RB which is the shift clock input signal to a 4-bit shift register 101. Starting from the normal state, all outputs of the shift register are at logic "0", thus providing a logic 1 at the output of a NOR gate G2. That logic 1 is shifted into the first bit of the register 101 at the trailing edge of the signal RB.

A logic 1 in the first bit of the register produces a signal SMONE that drives the output of the gate G2 to zero; pushing and releasing RB again 1, 2, or 3 times shifts the logic 1 and loads 0's into the front end. Each position of the logic 1 produces the following four control signals:

SMONE - set month enable
SDE - set day enable
SHRE - set hour enable
SMINE - set minute enable A fifth push of the recessed button shifts a logic 0 into the last bit to restore the mode to normal.

As the logic 1 is moved through the shift register, the mode control signals are applied to the display mode control unit 94 to cause the respective month, date, hour and minute digits to be displayed. The month digits are followed by a dash, and the hour digits are followed by a colon. A typical month display is thus 10-, while a typical hour display is 8:. The date digits are preceded by a dash and the minute digits are preceded by a colon. Typical date and minute displays would be -15 and :29, respectively. This display enables the user to see by position and presence of colon or dash, what horological data has been selected for setting. No setting takes place until the large button is depressed.

One of a set of four NAND gates G3 through G6 is enabled for each of the setting modes. When the large button is depressed, the enabled one of the gates transmits a corresponding slewing signal SMON*, SD*, SH* or SM* to the associated month, date, hour or minute counter in FIG. 2, (except SM* which is delayed to form a signal SMIN at a gate G7, and that is used as the slewing control signal for the minutes counters 28 and 30). For example, to set the hour, the recessed button is pushed three times to generate the signal SHRE. Upon pushing the large button, a signal SH* is transmitted by the gate G5 to slew the unit hours counter 32. Also, the dash is made visible if the time is AM. The button is held down until the signal SH* has gated enough clock pulses at the rate of 1Hz to advance the hours to the correct hour. There is then 1 second available to release the button. The mode control unit may then be returned to normal by stepping the logic 0's being loaded in all the way to the last bit.

No counter being slewed will increment slower counters, except the date counters 38 and 40, which can increment the months counters 42 and 44. This is because in all other cases the slew control signals SMIN and SH* block the overflow output to the next slower counters. For example, while slewing minutes, the user may count the minutes counters 28 and 30, past 59, to 00 and beyond, but there is no incrementing of the unit hours counter 32 because SMIN blocks any overflow from the tens-of-minutes counter 30. The overflow from the tens-of-date counter 40 is permitted to increment the month counters 42 and 44 while slewing, i.e. while SD* is present, so that when an unwanted day occurs, such as February 29, only a set date operation is required to set both the date and the month. The user merely slews the date counter to 1, and that automatically increments the month counter to 3.

When the logic 1 in the register 101 is shifted to the last bit, the signal SMINE causes the minute data to be displayed in the last two (right hand) digit positions for the purpose of setting. The colon is also displayed on the left so that the minutes displayed will not be confused with the date display. Gate G6 transmits a signal SM* when the large button is pushed, but the signal is not used directly to slew the minute counter. Instead it is used through NOR gate G7 to generate the signal SMIN that is delayed because it must wait for two 1Hz clock pulses to advance the state of SM* to G7. The signal SM* is also used by NOR gate G8 to momentarily generate a signal SZ to reset to zero the seconds counter. A delay circuit 102 consisting of three inverters provides the complement of the signal SM* to terminate the signal SZ in a very short period. The large button should not be pushed to start advancing the minutes until the exact second that a new minute begins. Otherwise the seconds, set to zero, will be in error.

If the time being kept by the watch is less than a minute fast, it can be corrected by pushing the large button when the seconds are really zero, but releasing less than a second later. The signal SM* then causes the seconds counters to be reset to zero. However, the 2-bit shift register 104 delays SM* long enough that G7 never puts out a logic 1 level, which enables a one step advance on every 1Hz falling edge. When the signal SM* occurs, it causes zeroes to be shifted into 104. After two clock pulses at the rate of 1Hz are applied to the 2-bit register, a zero will reach the second terminal of the NOR gate G7, thus providing a delay of 1 to 2 seconds after the large button is pushed before generating the signal SMIN to slew the minute counter. This period of 1 to 2 seconds assures the user ample time to release the large button before slewing the minute counter is started. After any setting mode is used, the shift register 101 must be shifted through to the normal state by repeatedly pushing the recessed button to produce pulses RB at the clock input of 101.

Before proceeding with a description of the display mode control unit (FIG. 4), it should be recalled that the normal display of horological data is hours and minutes separated by a colon, or months and date separated by a dash, except when displaying seconds following an extended hour-minute display command. For setting the month, date, hour or minute counters, only those counters being set are displayed through the operation of the display mode control unit. To be able to use the normal display control logic, but display only one or the other of paired counters, the pairs being: hours-, minute and months-date, it is convenient to generate in the setting mode control unit signals that will turn the unwanted displays off. It is also desirable that the display selected for setting be flashing at a 1Hz rate with the on time during the first half period of the 1Hz clock and off during the last half to save power and give the user maximum time to release the large push button after reaching the correct count. Also, when displaying seconds after an extended hour-minute display in the normal mode, it is desirable to flash the seconds display at the 1Hz rate to assist the user in anticipating the next second when timing some event. All that is accomplished by a logic network 105 which generates control signals FTO and LTO to turn the first two digits off (FTO) or the last two digits off (LTO), and to flash the other two digits not turned off if in any one of the four setting modes, or if displaying seconds in the normal mode. Considering first the display of seconds, when the control signal DSEC from the display mode control unit is at the logic 1 level, an OR gate G10 enables an AND gate G11 to transmit 1Hz square wave clock pulses through a NOR gate G12. The other two terminals of that NOR gate are at the logic 0 level because DSEC can be true only during the normal mode. The signal LTO thus alternates between the logic 1 and the logic 0 levels to turn off the last two digits where seconds are displayed while LTO is at the logic 1 level. FTO remains at the logic 1 level, where it is forced by the DSEC signal in NOR gate G13. During a setting mode which involves the last two digits, i.e., while in the set minutes or date mode, one of the other two input terminals of the gate G10 will be at a logic level 1 to again cause the last two digits to be turned off and on at the 1Hz rate. Meantime, since SMINE or SDE is at the logic 1 level, the first two digits are held off via NOR gate G13. If the setting mode selected involves the first two digits instead, the selected mode signal SHRE or SMONE is at the logic 1 level so that the last two digits are held off by the NOR gate G12, and the first two digits are flashed by the operation of OR gate G14 and AND gate G15. Whenever any setting mode is selected, the NOR gate G2 transmits a set enable signal SE* which causes the display mode control unit in FIG. 4 to generate a display on signal DISON which turns on all four digits for a setting mode. The FTO or LTO signal must then be relied upon to hold off the unwanted digits.

Figure 4:
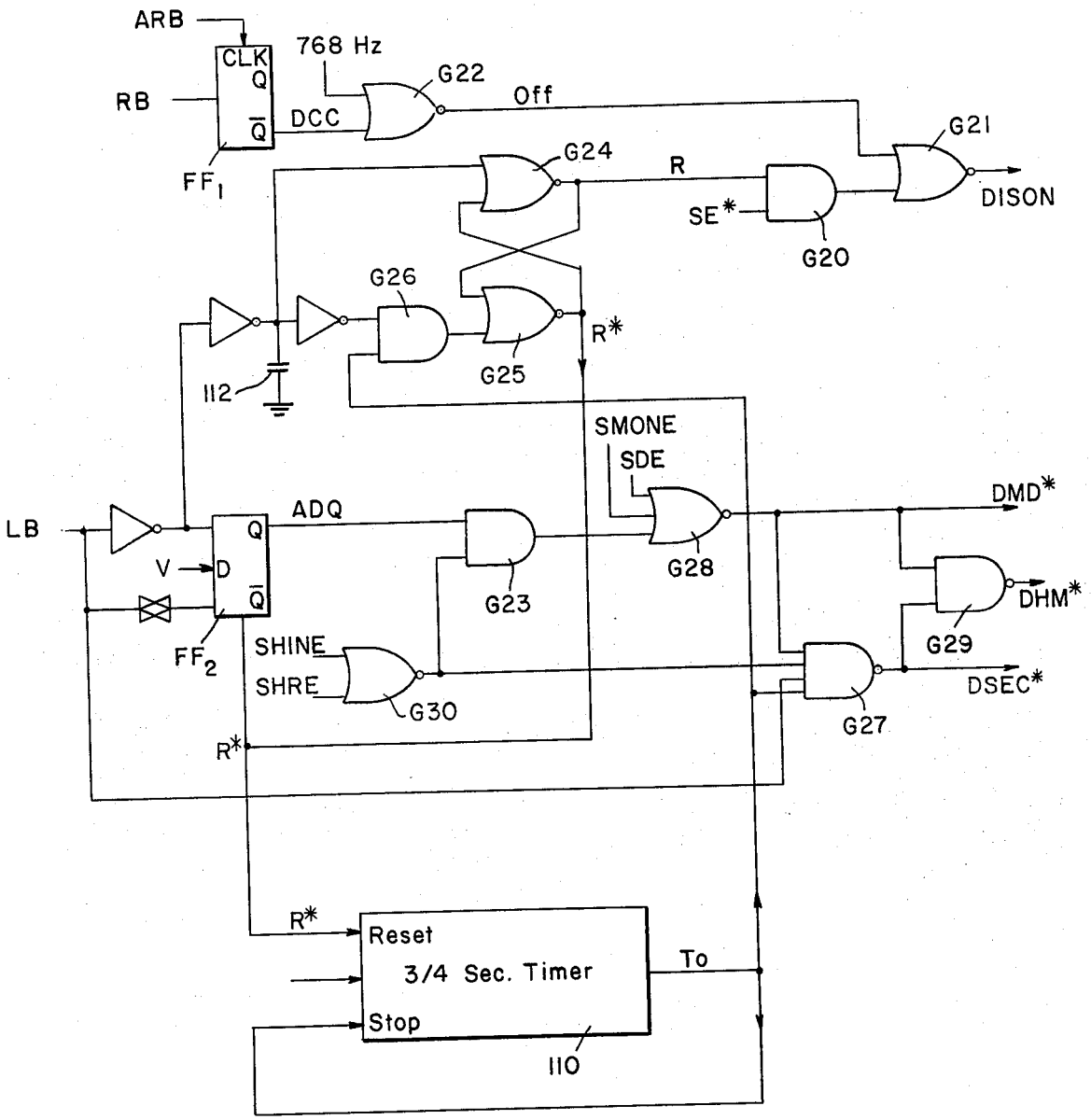
FIG. 4 is a logic diagram of the display mode control unit in the block diagram of FIG. 2.

The display mode control unit 94 responds to a large button LB, as described with reference to FIG. 2, to provide normal display of horological data when a setting mode has not been commanded by the recessed button. FIG. 4 illustrates an implementation of the display mode control unit. It includes a control AND gate G20 which when either input is a logic 0, forces the display to be on by allowing DISON to go to logic 1 whenever the duty cycle circuitry allows it by putting a logic 0 into NOR gate G21. While in a setting mode, the signal SE* goes to the logic 0 level, thus producing a logic 0 level at the output of the AND gate G20 for untimed display of the counters selected for setting. A second input signal, OFF, to the NOR gate G21 continually modulates DISON at a frequency (768Hz) so selected for the display multiplexing rate (192Hz) that the normal $\frac{1}{4}$ duty cycle of the display multiplexing rate is reduced to $\frac{1}{8}$, but only if a duty cycle control signal DCC is at the logic zero level. A toggle flip-flop $FF_1$ can be alternately set to place the watch display in the $\frac{1}{8}$ duty cycle mode and reset to place it in the $\frac{1}{4}$ duty cycle mode by pushing an optional recessed button ARB (see FIG. 1). Each time the button is pushed, the flip-flop changes state.

Assuming the flip-flop $FF_1$ is in the reset state, NOR gate G22 transmits a steady logic 0 level signal instead of the 768Hz clock. Then DISON is unmodulated when it is turned on either by SE* or by pushing the large button to produce the signal LB. Pushing the large button removes the reset signal to resettable delay flip-flop $FF_2$, but not until after the clock has fallen. This means the $FF_2$ output signal ADQ stays at a logic 0 level in response to only one push of the large button, LB. A flip-flop comprised of two NOR gates G24 and G25 is configured to transmit a signal R that initiates DISON during a normal display mode. The complementary output signal R* of that flip-flop is the reset of $FF_2$ and a $\frac{3}{4}$ second timer 110 which counts 8Hz pulses to time the display of hours and minutes. At the end of the $\frac{3}{4}$ second period, a time-out signal TO is emitted to reset the flip-flop comprised of gates G24 and G25 via a gate G26 if LB is no longer pushed. The signal R* then resets the flip-flop $FF_2$ and the timer 110 and terminates DISON.

If the user continues to depress the large button past the display timing period of $\frac{3}{4}$ second TO prevents further counting of the timer, the flip-flop $FF_2$ is not reset and a signal DSEC* is generated via NAND gate G27. This happens because NOR gate G28 continues to have all logic 0 inputs and a logic 1 output so that with the time out signal TO now at a logic 1 level, and the signal LB still at the logic 1 level, the NAND gate G27 has all logic 1 inputs. Before the time out signal occurs, gate G27 is disabled and only a signal DHM* to display hours and minutes is generated via a NAND gate G29.

When the large push button is quickly depressed twice, the first push causes the cross coupled gates G24 and G25 to turn on DISON and start the timer 110 as before. The second push clocks flip-flop $FF_2$ into the set state. Thus the signal ADQ from that flip-flop is now at the logic 1 level to enable the AND gate G23 which in turn causes the NOR gate G28 to output a signal at the logic 0 level. That disables the NAND gate G27 and causes a signal DMD* to be generated to display the month and date. If the large button is released quickly, the month and date display is timed by the timer 110, then turned off because TO reset the flip-flop comprised of NOR gates G24 and G25. If the button is not released, the cross-coupled gates don't flip back and DISON is enabled until the button is released.

The display mode control just described is affected by the setting mode control output signals SMONE, SDE, SHRE and SMINE, one of which is always generated if the setting mode control unit is not set to normal. When SMONE is present to set the month counters, a signal DMD* is generated by the NOR gate G28 to display the month and date. The last two digits are blanked by the signal LTO described with reference to FIG. 3, leaving on only the first two digits (month) and the dash. When SDE is present, the same signal DMD* is generated in the same way and FTO blanks the first two digits, leaving only the last two digits on and the dash before them. When either the signal SMINE or SHRE is present to display minutes or hours, a NOR gate 30 transmits a logic 0 to the NAND gate G27. At the same time a logic 1 is generated at G28 via AND gate G23. The output of NAND gate G27 is a logic 1. Both inputs of NAND gate G29 are then at the logic 1 level so that gate output transmits a logic 0 on DHM* to display hours and minutes. If SMINE is on, the first two digits are held off by the signal FTO (FIG. 3) and if SHRE is on, the last two digits are held off by the signal LTO (FIG. 3). In either case, the colon is turned on. All of these display control signals, for either the normal mode or the setting modes, are applied to the multiplex control unit 66 to effect the necessary display.

What is claimed is:

1. A digital watch including a push button recessed in the case, and means for sequentially selecting, month, date, hours, or minutes for setting by successive pushes of said recessed button, means responsive to said selecting means for displaying said selected horological data in assigned first and second pairs of digit positions with a dash when the data selected is either month or date and a colon when the data selected is either hours or minutes, and means for setting the data selected in response to pushing another protruding button while that data is displayed for viewing.

2. A digital watch as defined in claim 1 including means for counting the first and second set of twelve hours for each day, and further including means for displaying said dash with said colon when hours are selected for setting, setting is actually occurring because the protruding button is depressed, and said means for counting said first and second set of twelve hours indicates the hour displayed is in the first set, thus indicating when hours are in the AM.

3. A digital watch as defined in claim 1 wherein said means for setting the data selected advances that data one unit per second, and said protruding button is held pushed in until the right setting is displayed.

4. A digital watch as defined in claim 1 wherein said seconds are instantaneously reset to zero when said protruding button is depressed and the data selected for setting is minutes, whereby seconds are automatically reset upon the initiation of minutes advance, but including means to delay for about one second or more the actual advance of the minutes, thus allowing resetting seconds to zero without affecting minutes by pushing said protruding button for less than one second.

5. A digital watch as defined in claim 1 including means for flashing the display of that data selected for setting with the display on for the first half of every second, thereby saving power and aiding the user in timing release of said protruding push button when the correct value is displayed.

6. A digital watch as defined in claim 5 including means for advancing said selecting means for setting month, date, hours and minutes past the selection of minutes into a normal mode of operation and display of horological data and back through the same sequence in response to successive pushes of said recessed button, whereby a normal mode or any one of at least four setting modes of operation can be repeatedly selected.

* * * * *